US006344786B1

(12) United States Patent
Chin

(10) Patent No.: US 6,344,786 B1
(45) Date of Patent: Feb. 5, 2002

(54) TELESCOPING BOBBIN

(75) Inventor: Kwong Kei Chin, Fremont, CA (US)

(73) Assignee: Artesyn Technologies, Inc., Boca Raton, FL (US)

( * ) Notice: Subject to any disclaimer, the term of this patent is extended or adjusted under 35 U.S.C. 154(b) by 0 days.

(21) Appl. No.: 09/684,102

(22) Filed: Oct. 6, 2000

(51) Int. Cl.[7] ..... H04F 27/29; H04F 27/30
(52) U.S. Cl. ..... 336/198; 336/192; 336/208
(58) Field of Search ..... 336/192, 198, 336/208

(56) References Cited

U.S. PATENT DOCUMENTS

| | | | | |
|---|---|---|---|---|
| 4,617,543 A | | 10/1986 | Akachi et al. | |
| 4,988,968 A | * | 1/1991 | Tochio et al. | 336/98 |
| 5,015,984 A | * | 5/1991 | Vialaneix | 336/197 |
| 5,534,839 A | * | 7/1996 | Mackin et al. | 336/192 |
| 5,673,013 A | * | 9/1997 | Moody et al. | 336/192 |

* cited by examiner

*Primary Examiner*—Anh Mai
(74) *Attorney, Agent, or Firm*—Kirkpatrick & Lockhart LLP

(57) ABSTRACT

A telescoping bobbin. The telescoping bobbin includes a first bobbin element and a second bobbin element adapted to receive at least a portion of the first bobbin element. The first bobbin element includes a first member having first and second ends, a first flange extending from the first end of the first member, and a first base extending from the second end of the first member. The second bobbin element includes a second member having first and second ends, a second flange extending from the first end of the second member, and a second base extending from the second end of the second member. The second flange includes a first portion extending generally outward from the second member and a second portion extending generally inward from the second member. When the first bobbin element is received by the second bobbin element, the second portion is adjacent the first flange and the second base covers at least a portion of the first base.

51 Claims, 12 Drawing Sheets

TELESCOPING BOBBIN

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a transformer and, more particularly, to a transformer incorporating a telescoping bobbin.

2. Description of the Background

To meet the lawful safety standards issued in each country, a transformer must satisfy a host of safety standards regulated by various agencies in each of the countries. One important safety standard that relates to a transformer is what is commonly known as creeping insulation distance. The creeping distance may be defined as the shortest distance between adjacent conductors measured along the surface of a solid dielectric material interposed therebetween. If the creeping distance between such adjacent conductors is too short, a spark discharge may sometimes arise between the adjacent conductors. Where the insulation between the adjacent conductors is not sufficient, a spark discharge between adjacent conductors may occur.

Whenever high voltage is present, the various safety agencies dictate specific insulation requirements between adjacent conductors of the transformer to minimize the risk of injury to personnel working with or near the transformer. One example of a case where a high voltage is present is a low voltage power supply that is energized with a voltage from utility mains. Such a power supply typically includes a transformer with at least one primary winding electrically coupled to the utility mains. A secondary winding or windings may provide the low voltage outputs and voltages less than 40 Volts RMS are generally considered safe.

To help insure that the mains voltage is not inadvertently shorted to the low voltage windings through the insulation, it is known in the art to use multiple modes of electrical insulation between the windings. One method is to use two or three layers of thin insulating material to separate the primary and secondary windings, wherein each layer of electrical insulation has sufficient dielectric strength to withstand an elevated voltage. Another method is to place a single layer of sufficiently thick and solid insulation between the primary and secondary windings. Nevertheless, the layer or layers of insulation have boundaries or margins, and electrical paths connecting the primary winding to the secondary winding may form around these boundaries without passing directly through the insulation. As a result, the various safety agencies also require certain minimum spacing around any such boundaries (creeping distance) or through any air gaps (clearance) to minimize the potential of the formation of such electrical paths. It is known in the art to use spacers of insulating material such as margin tape to help meet these minimum spacing requirements. However, the required electrical spacings may approach the total length of the windings, leaving little or no space to place the windings. It is also known in the art to use tubular sleeving over the ends of the windings to increase the creeping distance around the boundaries. However, the use of margin tapes or sleeving limits the degree of winding automation that is possible.

A telescoping bobbin, also known as a concentric bobbin or coaxial bobbin, has been utilized to help eliminate the need to use margin tapes or sleeving to meet the required safety standards. The telescoping bobbin typically includes an inner bobbin that carries a primary winding and a separate outer bobbin that carries a secondary winding, where the thickness of the material comprising the inner and outer bobbin is sufficient to provide the required insulation in a single layer. The telescoping bobbin also typically includes flanges on each end of the inner and outer bobbins that extend the creeping distance between the primary and secondary windings. An example of such a telescoping bobbin is disclosed in U.S. Pat. No. 4,617,543.

As the size of transformers decrease, the ability to achieve the required spacings, becomes increasingly difficult. For the relatively small transformers required by certain applications, even transformers incorporating telescoping bobbins known in the art will not meet the required safety standards. Thus, there exists a need for a transformer that overcomes the limitations, shortcomings, and disadvantages of prior art transformers.

SUMMARY OF THE INVENTION

The present invention meets the identified need, as well as other needs, as will be more fully understood following a review of this specification and the accompanying drawings. The present invention is directed generally to a transformer that incorporates a telescoping bobbin to overcome isolation clearance problems associated with decreasing the size of prior art transformers. The telescoping bobbin of the present invention, according to one embodiment, includes a first bobbin element and a second bobbin element adapted to receive at least a portion of the first bobbin element. The first bobbin element includes a first member having first and second ends, a first flange extending from the first end of the first member, and a first base extending from the second end of the first member. The second bobbin element includes a second member having first and second ends, a second flange extending from the first end of the second member, and a second base extending from the second end of the second member. The second flange includes first and second portions. The first portion extends generally outward from the second member and the second portion extends generally inward from the second member. When the first bobbin element is received by the second bobbin element, the second portion is adjacent the first flange and the second base covers at least a portion of the first base.

According to another embodiment, the telescoping bobbin of the present invention includes a first bobbin element and a second bobbin element adapted to receive at least a portion of the first bobbin element. The first bobbin element includes a first member having first and second ends, a first collar extending from the first member proximate the first end of the first member, and a first flange extending from the second end of the first member. The second bobbin element includes a second member having first and second ends, a third collar extending from the second member proximate the first end of the second member, a second flange extending from the second end of the second member, and a fourth collar extending from the second member proximate the second end of the second member. The second member includes a shoulder extending therefrom proximate the first end of the second member and a neck portion at the first end of the second member. The fourth collar is between the third collar and the second flange.

BRIEF DESCRIPTION OF THE DRAWINGS

For the present invention to be clearly understood and readily practiced, the present invention will be described in conjunction with the following figures, wherein.

DETAILED DESCRIPTION OF THE INVENTION

Figure 1:
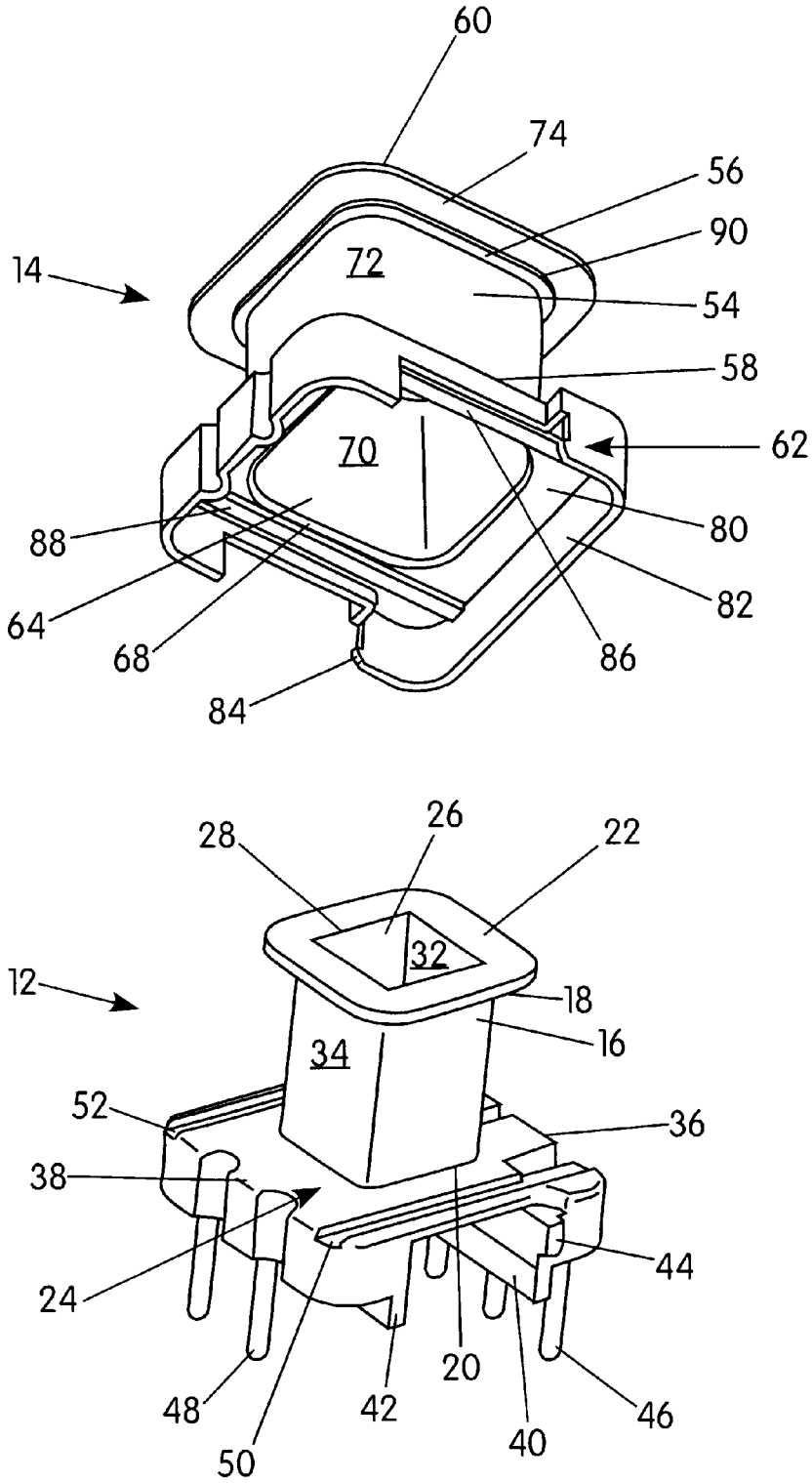
FIG. 1 illustrates an exploded perspective view of a telescoping bobbin according to one embodiment of the present invention.

FIG. 1 illustrates an exploded perspective view of a telescoping bobbin 10 according to one embodiment of the present invention. From the description set forth hereinbelow, it will be appreciated that the telescoping bobbin 10 may be referred to as a vertical telescoping bobbin. The telescoping bobbin 10 includes a first bobbin element 12 and a second bobbin element 14 adapted to receive at least a portion of the first bobbin element 12. When the first bobbin element 12 is received by the second bobbin element 14, the first bobbin element 12 may be referred to as an inner bobbin element of the telescoping bobbin 10 and the second bobbin element 14 may be referred to as an outer bobbin element of the telescoping bobbin 10. The first and second bobbin elements 12, 14 are fabricated at least in part from a dielectric material.

The first bobbin element 12 includes a first member 16 having first and second ends 18, 20, respectively, a first flange 22 extending from the first end 18 of the first member 16, and a first base 24 extending from the second end 20 of the first member 16.

Figure 2:
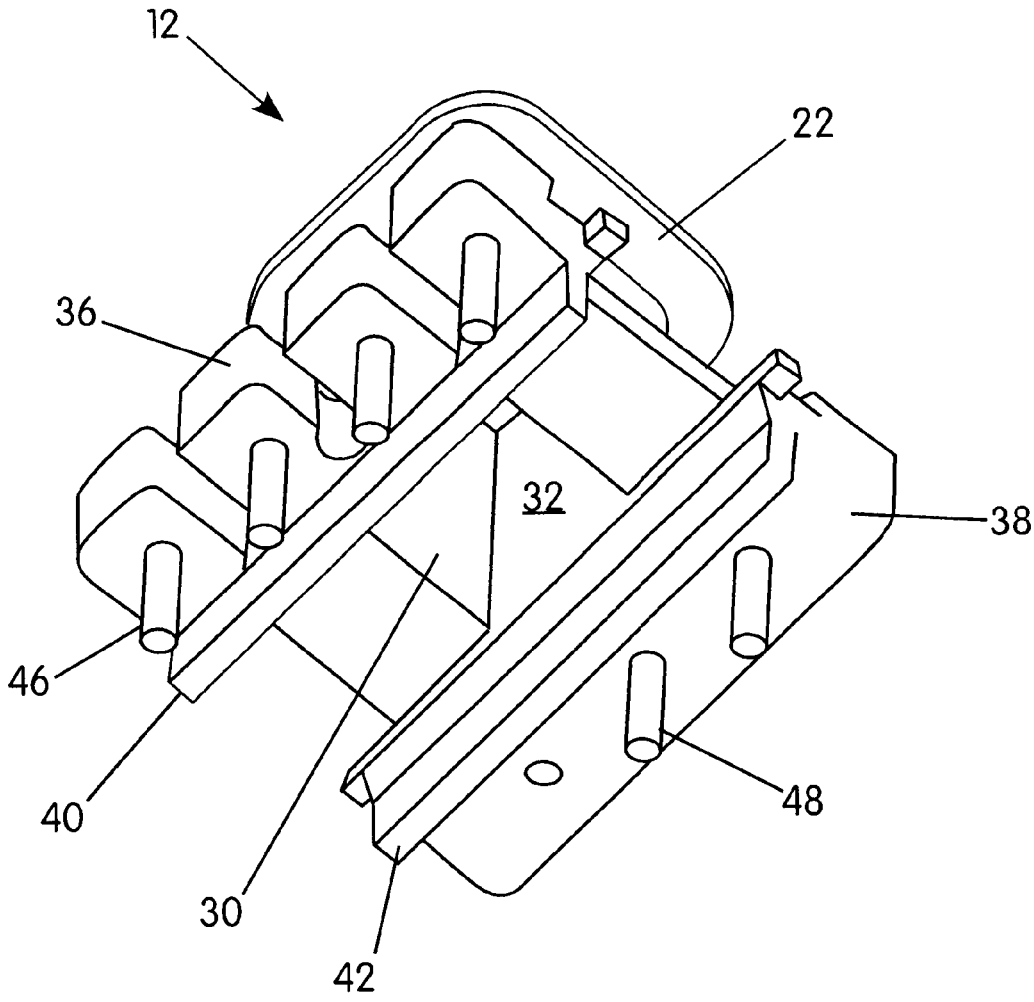
FIG. 2 illustrates a partial bottom perspective view of the telescoping bobbin shown in FIG. 1.

The first member 16 defines a first hollow opening 26 having first and second ends 28, 30, respectively, and preferably having a uniform cross-sectional area. The first end 28 of the first hollow opening 26 is proximate the first end 18 of the first member 16 and the second end 30 of the first hollow opening 26 is proximate the second end 20 of the first member 16. The second end 30 of the first hollow opening 26 may be seen more clearly in FIG. 2. The first member 16 may, for example, be a generally rectangularly shaped column or may, for example, be a generally cylindrically shaped column, although it will be appreciated that the first member 16 may have other shapes, as may be required by particular applications. The first member 16 includes first and second surfaces 32, 34, respectively. The first surface 32 may, for example, be referred to as the inner surface of the first member 16 and the second surface 34 may, for example, be referred to as the outer surface of the first member 16. The first end 18 of the first member 16 may, for example, be referred to as the upper end of the first member 16 and the second end 20 of the first member 16 may, for example, be referred to as the lower end of the first member 16.

The first flange 22 may extend generally outward from the first end 18 of the first member 16 and may be integrally formed with the first member 16, although it will be appreciated that the first flange 22 may be separately formed.

The first base 24 may include first and second terminal bars 36, 38, respectively, extending from the second end 20 of the first member 16, first and second lips 40, 42, respectively, between the first and second terminal bars 36, 38, respectively, and a locking ramp 44 extending generally outward therefrom. The first and second terminal bars 36, 38, respectively, may be adapted to receive first and second sets of terminal pins 46, 48, respectively. The first lip 40 may, for example, be adjacent to the first terminal bar 36 and the second lip 42 may, for example, be adjacent to the second terminal bar 38. The first base 24 may also define first and second grooves 50, 52, respectively, and may be integrally formed with the first member 16, although it will be appreciated that the first base 24 may be separately formed.

The second bobbin element 14 includes a second member 54 having first and second ends 56, 58, respectively, a second flange 60 extending from the first end 56 of the second member 54, and a second base 62 extending from the second end 58 of the second member 54.

The second member 54 defines a second hollow opening 64 having first and second ends 66, 68, respectively, and preferably having a uniform cross-sectional area. The second hollow opening 64 is sized to receive the first flange 22 and the first member 16 of the first bobbin element 12 when the first bobbin element 12 is received by the second bobbin element 14. The first end 66 of the second hollow opening 64 is proximate the first end 56 of the second member 54 and the second end 68 of the second hollow opening 64 is proximate the second end 58 of the second member 54. The second member 54 may, for example, be a generally rectangularly shaped column or may, for example, be a generally cylindrically shaped column, although it will be appreciated that the second member 54 may have other shapes, as may be required by particular applications. The second member 54 includes first and second surfaces 70, 72, respectively. The first surface 70 of the second member 54 may, for example, be referred to as the inner surface of the second member 54 and the second surface 72 may, for example, be referred to as the outer surface of the second member 54. The first end 56 of the second member 54 may, for example, be referred to as the upper end of the second member 54 and the second end 58 of the second member 54 may, for example, be referred to as the lower end of the second member 54.

The second flange 60 includes first and second portions 74, 76, respectively. The first portion 74 may, for example, extend generally outward from the second member 54 and the second portion 76 may, for example, extend generally inward from the second member 54. The second portion 76 of the second flange 60, as shown in FIGS. 3A and 3B, may define a first opening 78 having a cross-sectional area approximately the same as the cross-sectional area of the first hollow opening 26. When the first bobbin element 12 is received by the second bobbin element 14, the second portion 76 of the second flange 60 may be positioned adjacent and overlap with the first flange 22 of the first bobbin element 12. The second flange 60 may be integrally formed with the second member 54, although it will be appreciated that the second flange 60 may be separately formed.

The second base 62 may include a flange portion 80 extending generally outward from the second end 58 of the second member 54, a skirt portion 82 extending generally downward from the flange portion 80 of the second base 62, and a locking tab 84. When the first bobbin element 12 is received by the second bobbin element 14, the second base 62 may cover at least a portion of the first base 24, and the locking tab 84 may cooperate with the locking ramp 44 of the first bobbin element 12 to keep the first bobbin element 12 positioned within the second bobbin element 14. The second base 62 may also define first and second ridges 86, 88, respectively, that cooperate with the first and second grooves 50, 52, respectively, of the first base 24 when the first bobbin element 12 is received by the second bobbin element 14. The second base 62 may be integrally formed with the second member 54, although it will be appreciated that the second base 62 may be separately formed.

The second bobbin element 14 may also include a first collar 90 extending generally outward from the second member 54 proximate the first end 56 or the second end 58 of the second member 54, and also may include a second collar 92 extending generally outward from the second member 54 proximate the end of the second member 54 opposite the end nearest the first collar 90. The first and second collars 90, 92, respectively, may be integrally formed with the second member 54, although it will be appreciated that the first and second collars 90, 92, respectively, may be separately formed.

Figure 3:
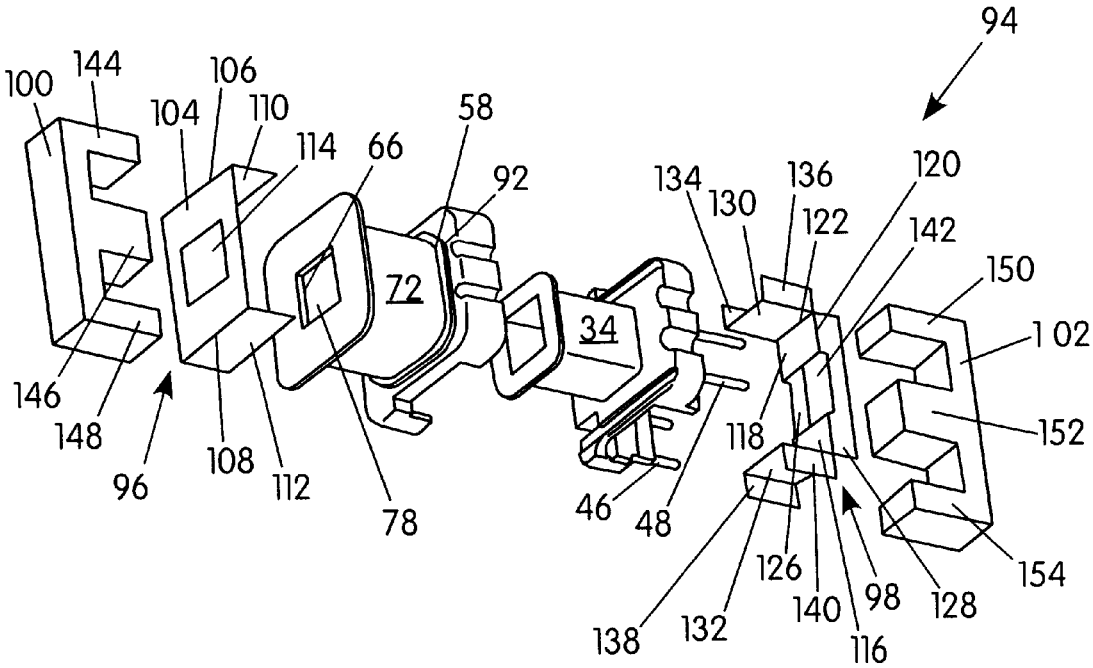
FIG. 3 illustrates an exploded perspective view of a transformer incorporating the telescoping bobbin described hereinabove with respect to FIG. 1.

FIG. 3 illustrates an exploded perspective view of a transformer 94 incorporating the telescoping bobbin 10 described hereinabove with respect to FIG. 1. The transformer 94 may, for example, be a component in an AC/DC converter utilized as an external adapter for devices such as, for example, cable modems, personal computers, laptop computers, palm pilots, or other devices. It is well known in the art for a transformer to have primary and secondary windings of conductive wire such as shown in FIGS. 4A and 4B. However, for purposes of clarity, the primary and secondary windings 95*a*, 95*b*, respectively, of transformer 94 are not shown in FIG. 3. The transformer 94 may also include the first and second set of terminal pins 46, 48, respectively, first and second insulation shields 96, 98, respectively, and first and second magnetic cores 100, 102, respectively.

The primary winding of conductive wire 95*a* may be wound around the second surface 34 of the first member 16, and the secondary winding of conductive wire 95*b* may be wound around the second surface 72 of the second member 54. As is well known in the art, the leads of the primary winding of conductive wire may, for example, be terminated at the first set of terminal pins 46 and the leads of the secondary winding of conductive wire may, for example, be terminated at the second set of terminal pins 48. The first and second sets of terminal pins 46, 48, respectively, may serve as electrical connecting points to the transformer 94.

The first and second insulation shields 96, 98, respectively, are fabricated at least in part from a dielectric material. The first insulation shield 96 includes a first main portion 104 having first and second edges 106, 108, respectively, a first wing 110 extending from the first main portion 104 at the first edge 106, and a second wing 112 extending from the first main portion 104 at the second edge 108. The first main portion 104 defines a second opening 114 having a cross-sectional area approximately the same as the cross-sectional area of the first opening 78. When the transformer 94 is assembled, the first main portion 104 is adjacent the second flange 60, the first wing 110 is proximate the first end 56 of the second member 54, and the second wing 112 is proximate the first end 56 of the second member 54.

The second insulation shield 98 includes a second main portion 116 having first, second, third, and fourth edges 118, 120, 122, 124, respectively, a first wing 126 extending from the second main portion 116 at the first edge 118, a second wing 128 extending from the second main portion 116 at the second edge 120, a third wing 130 extending from the second main portion 116 at the third edge 122, a fourth wing 132 extending from the second main portion 116 at the fourth edge 124, fifth and sixth wings 134, 136, respectively, extending from the third wing 130, and seventh and eighth wings 138, 140, respectively, extending from the fourth wing 132. The second main portion 116 defines a third opening 142 having a cross-sectional area approximately the same as the cross-sectional area of the second opening 114. When the transformer 94 is assembled, the second main portion 116 is adjacent the second base 62 between the first and second lips 40, 42, respectively. The first wing 126 may, for example, be adjacent the first lip 40 and the second wing 128 may, for example, be adjacent the second lip 42. The third and fourth wings 130, 132, respectively, are proximate the second end 58 of the second member 54.

The first magnetic core 100 may be an E-shaped magnetic core having first, second, and third pole pieces 144, 146, 148, respectively. The first and third pole pieces 144, 148, respectively, may, for example, be referred to as the outer pole pieces of the first magnetic core 100 and the second pole piece 146 may, for example, be referred to as the center pole piece of first magnetic core 100. To assemble the transformer 94, the second pole piece 146 may be inserted through the second opening 114, through the first opening 78, and into the first hollow opening 26 at the first end 28 of the first hollow opening 26 such that at least a portion of the second pole piece 146 is received by the first member 16, the first wing 110 of the first insulation shield 96 is between the first pole piece 144 and the second member 54 proximate the first end 56 of the second member 54, and the second wing 112 is between the third pole piece 148 and the second member 54 proximate the first end 56 of the second member 54.

The second magnetic core 102 may be an E-shaped magnetic core having fourth, fifth, and sixth pole pieces 150, 152, 154, respectively. The fourth and sixth pole pieces 150, 154, respectively, may, for example, be referred to as the outer pole pieces of the second magnetic core 102 and the fifth pole piece 152 may, for example, be referred to as the center pole piece of the second magnetic core 102. To assemble the transformer 94, the fifth pole piece 148 may be inserted through the third opening 142, between the first and second lips 40, 42, respectively, of the first base 24, and into the first hollow opening 26 at the second end 30 of the first hollow opening 26 such that at least a portion of the fifth pole piece 152 is received by the first member 16, the third wing 130 is between the fourth pole piece 150 and the second member 54 proximate the second end 58 of the second member 54, and the fourth wing 132 is between the sixth pole piece 154 and the second member 54 proximate the second end 58 of the second member 54. When electric power is applied to the transformer 94, the first and second magnetic cores 100, 102, respectively, may be considered as electrical conductors.

Figure 4:
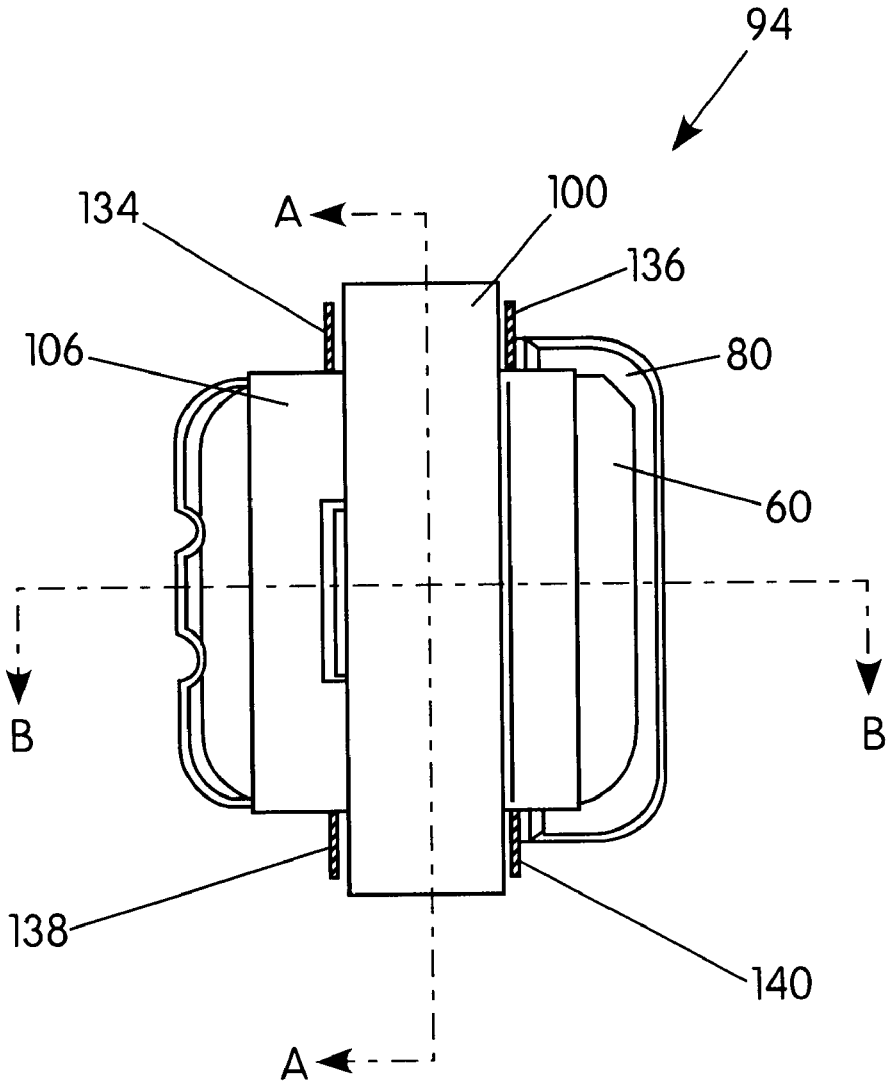
FIG. 4 illustrates a top view of the transformer described hereinabove with respect to FIG. 3.
Figure 4A:
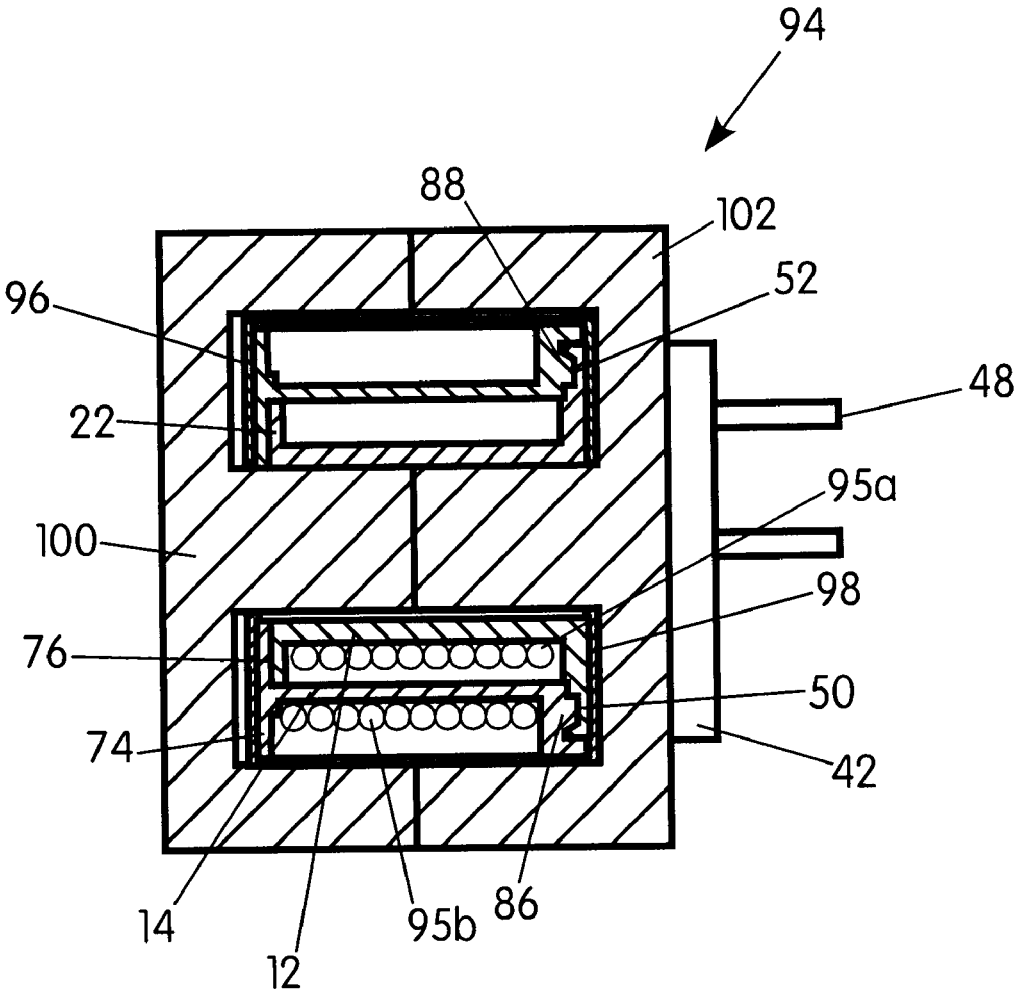
FIG. 4A illustrates a cross-sectional view of the transformer projected from section plane A—A of FIG. 4.
Figure 4B:
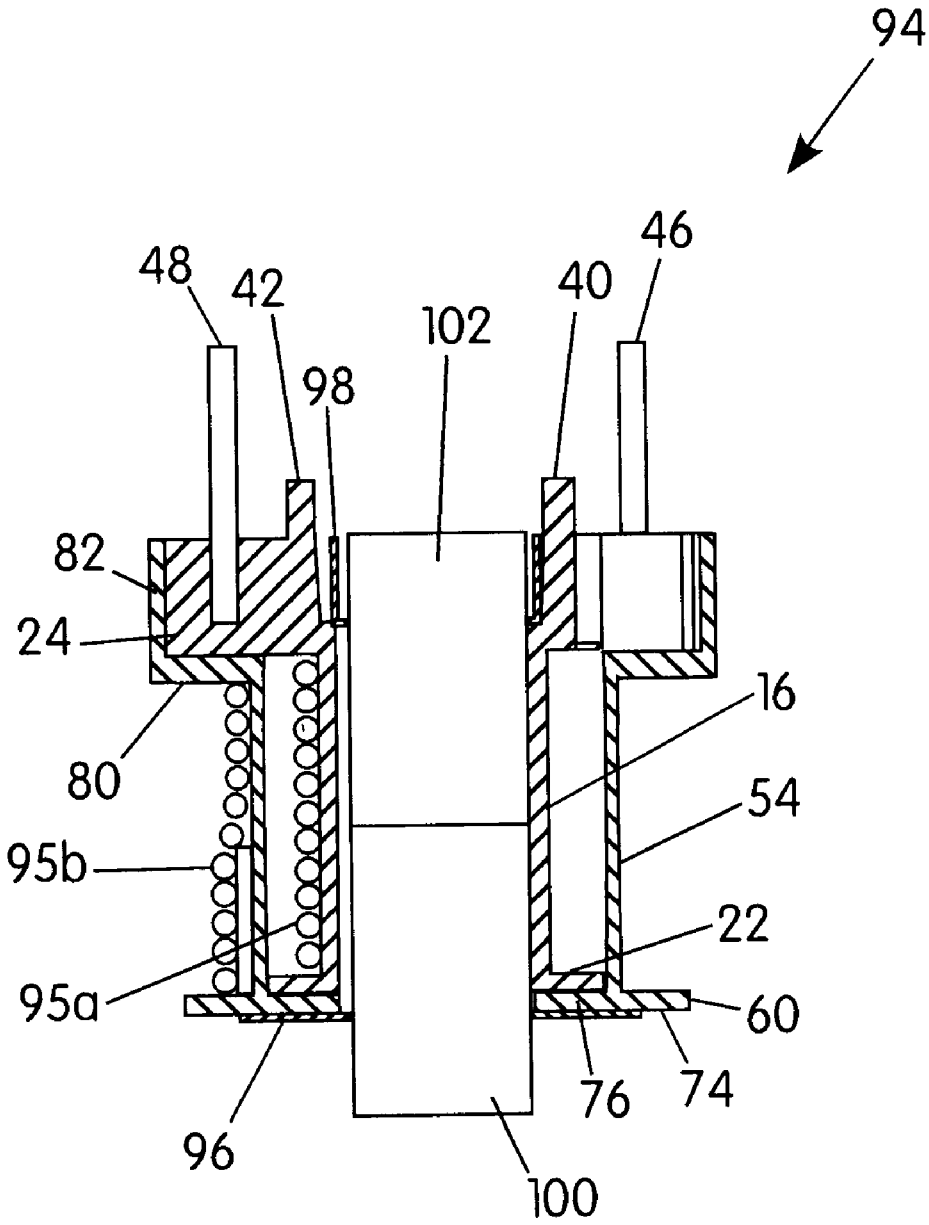
FIG. 4B illustrates a cross-sectional view of the transformer projected from section plane B—B of FIG. 4.

FIG. 4 illustrates a top view of the transformer 94 described hereinabove with respect to FIG. 3. FIGS. 4A and 4B illustrate cross-sectional views projected from section planes A—A and B—B respectively. As discussed hereinabove, as the size of a transformer is reduced, it becomes increasingly difficult to maintain the minimum creeping distance between certain conductive components as required by various safety regulations. FIGS. 4A and 4B illustrate features of the present invention that cooperate to maintain the required creeping distance between certain electrical conductors. Once again, for purposes of clarity, the primary and secondary windings 95*a*, 95*b*, respectively, of transformer 94 are not shown in FIG. 4.

The first insulation shield 96 may serve to lengthen the creeping distance between the first magnetic core 100 and the secondary winding of conductive wire 95*b* wound around the second surface 72 of the second member 54 proximate the first end 56 of the second member 54 and the second insulation shield 98 may serve to lengthen the creeping distance between the second magnetic core 102 and the secondary winding of conductive wire 95*b* wound around the second surface 72 of the second member 54 proximate the second end 58 of the second member 54. For example, the first main portion 104 of the first insulation shield 96 may serve to lengthen the creeping distance from the first magnetic core 100 to the secondary winding of conductive wire 95*b* proximate the second flange 60 of the second member 54 and the first and second wings 110, 112, respectively, of the first insulation shield 96 may serve to lengthen the creeping distance between the first and third pole pieces 144, 148, respectively, of the first magnetic core 100 and the secondary winding of conductive wire 95*b* proximate the first end 56 of the second member 54.

With respect to features of the telescoping bobbin 10 that are incorporated into the transformer 94, the first and second lips 40, 42, respectively, of the first base 24 may serve as a barrier to lengthen the creepage distance between the second magnetic core 102 and the first and second sets of terminal pins 46, 48, respectively. The overlap of the first and second flanges 22, 60, respectively, may serve to lengthen the surface creeping path from the primary winding of conductive wire 95*a* wound around the second surface 34 of the first member 16 to the secondary winding of conductive wire 95*b* wound around the second surface 72 of the second member 54 proximate the first ends 18, 56, respectively, of the first and second members 16, 54, respectively. The covering of the first base 24 by the second base 62 may serve to lengthen the creeping path from the primary winding of conductive wire 95*a* wound around the second surface 34 of the first member 16 to the secondary winding of conductive wire 95*b* wound around the second surface 72 of the second member 54 proximate the second ends 20, 58, respectively, of the first and second members 16, 54, respectively. The cooperation of the first and second ridges 86, 88, respectively, with the first and second grooves 50, 52, respectively, may serve to lengthen the surface creeping path from the primary winding of conductive wire 95*a* wound around the second surface 34 of the first member 16 to the secondary winding of conductive wire 95*b* wound around the second surface 72 of the second member 54. The first and second collars 90, 92, respectively, may serve to indicate a desired coil radial margin for the secondary winding of conductive wire 95*b* wound around the second surface 72 of the second member 54.

Figure 5:
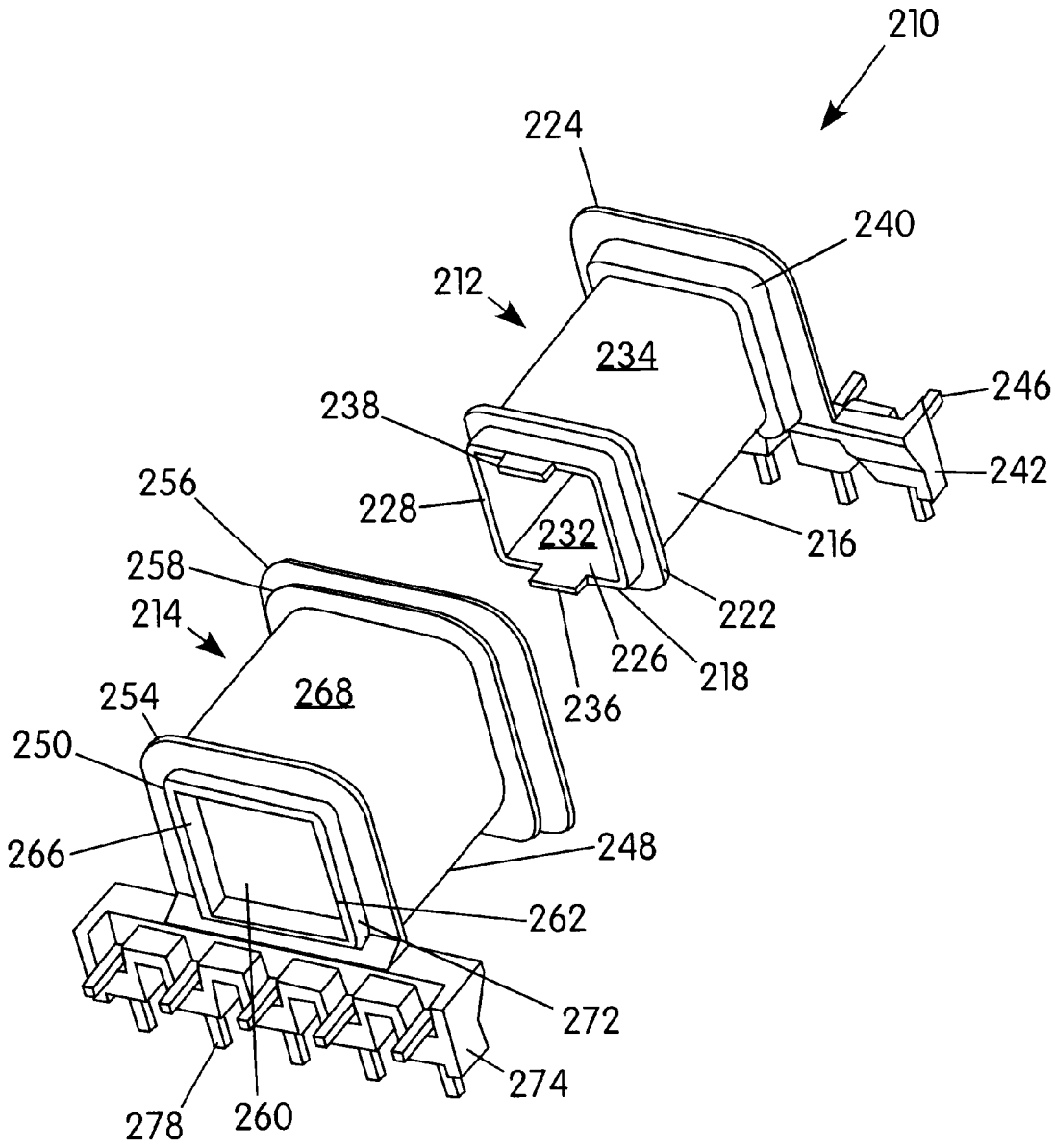
FIGS. 5 and 6 illustrate exploded perspective views of a telescoping bobbin according to another embodiment of the present invention.
Figure 6:
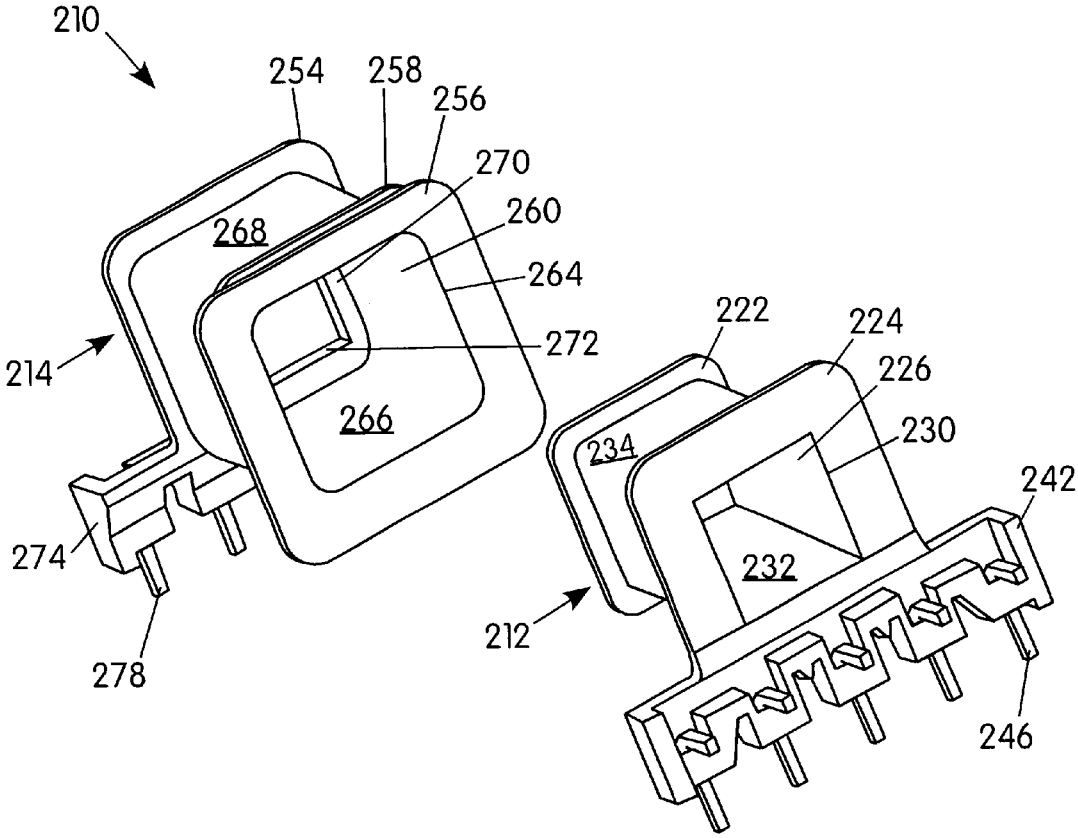

FIGS. 5 and 6 illustrate exploded perspective views of a telescoping bobbin 210 according to another embodiment of the present invention. From the description set forth hereinbelow, it will be appreciated that the telescoping bobbin 210 may be referred to as a horizontal telescoping bobbin. The telescoping bobbin 210 includes a first bobbin element 212 and a second bobbin element 214 adapted to receive at least a portion of the first bobbin element 212. When the first bobbin element 212 is received by the second bobbin element 214, the first bobbin element 212 may be referred to as the inner bobbin element of the telescoping bobbin 210 and the second bobbin element 214 may be referred to as the outer bobbin element of the telescoping bobbin 210. The first and second bobbin elements 212, 214 are fabricated at least in part from a dielectric material.

The first bobbin element 212 includes a first member 216 having first and second ends 218, 220, respectively, a first collar 222 extending from the first member 216 proximate the first end 218 of the first member 216, and a first flange 224 extending from the second end 220 of the first member 216.

The first member 216 defines a first hollow opening 226 having first and second ends 228, 230, respectively, and preferably having a uniform cross-sectional area. The first end 228 of the first hollow opening 226 is proximate the first end 218 of the first member 216 and the second end 230 of the first hollow opening 226 is proximate the second end 220 of the first member 216. The first member 216 may, for example, be a generally rectangularly shaped column or may, for example, be a generally cylindrically shaped column, although it will be appreciated that the first member 216 may have other shapes, as may be required by particular applications. The first member 216 includes first and second surfaces 232, 234, respectively. The first surface 232 may, for example, be referred to as the inner surface of the first member 216 and the second surface 234 may, for example, be referred to as the outer surface of the first member 216.

The first collar 222 may extend generally outward from the first member 216 proximate the first end 218 of the first member 216 and may be integrally formed with the first member 216, although it will be appreciated that the first collar 222 may be separately formed.

The first flange 224 may extend generally outward from the second end 220 of the first member 216 and may be integrally formed with the first member 216, although it will be appreciated that the first flange 224 may be separately formed.

The first bobbin element 212 may also include first and second locking tabs 236, 238, respectively, extending from the first end 218 of the first member 216, a second collar 240 extending from the first member 216 proximate the second end 220 of the first member 216, and a first terminal bar 242 proximate the second end 220 of the first member 216. The first terminal bar 242 may be adapted to receive a first set of terminal pins 246. The first flange 224 and the first terminal bar 242 may serve to retain the first set of terminal pins 246 when the first set of terminal pins 246 is received by the first terminal bar 242. The first and second locking tabs 236, 238, respectively, the second collar 240, and the first terminal bar 242 may be integrally formed with the first member 216, although it will be appreciated that they may be separately formed.

The second bobbin element 214 includes a second member 248 having first and second ends 250, 252, respectively, a third collar 254 extending from the second member 248 proximate the first end 250 of the second member 248, a second flange 256 extending from the second end 252 of the second member 248, and a fourth collar 258 extending from the second member 248 proximate the second end 252 of the second member 248.

The second member 248 defines a second hollow opening 260 having first and second ends 262, 264, respectively. The second hollow opening 260 is sized to receive the first collar 222, the second collar 240, and the first member 216 when the first bobbin element 212 is received by the second bobbin element 214. The first end 262 of the second hollow opening 260 is proximate the first end 250 of the second member 248 and the second end 264 of the second hollow opening 260 is proximate the second end 252 of the second member 248. The second member 248 may, for example, be a generally rectangularly shaped column or may, for example, be a generally cylindrically shaped column, although it will be appreciated that the second member 248 may have other shapes, as may be required by particular applications. The second member 248 includes first and second surfaces 266, 268, respectively. The first surface 266 of the second member 248 may, for example, be referred to as the inner surface of the second member 248 and the second surface 268 may, for example, be referred to as the outer surface of the second member 248.

The second member 248 also includes a shoulder 270 extending generally inward therefrom proximate the first end 250 of the second member 248 and a neck portion 272 at the first end 250 of the second member 248, the neck portion 272 preferably having a uniform cross-sectional area. As a result of the inwardly extending shoulder 270, the cross-sectional area of the neck portion 272 of the second member 248 is less than the cross-sectional area of the second member 248 at the second end 252 of the second member 248. When the first bobbin element 212 is received by the second bobbin element 214, the shoulder 270 is positioned adjacent and overlaps with the first collar 222 of the first bobbin element 212, and the first and second locking tabs 236, 238, respectively, of the first member 216 cooperate with the neck portion 272 of the second member 248 at the first end 250 of the second member 248 to keep the first bobbin element 212 received by the second bobbin element 214.

The third collar 254 may extend generally outward from the second member 248 proximate the first end 250 of the second member 248. The third collar 254 may be integrally formed with the second member 248, although it will be appreciated that the third collar 254 may be separately formed.

The second flange 256 may extend generally outward from the second end 252 of the second member 248. When the first bobbin element 212 is received by the second bobbin element 214, the second flange 256 may be positioned adjacent and overlap with the first flange 224 of the first bobbin element 212. The second flange 256 may be integrally formed with the second member 248, although it will be appreciated that the second flange may be separately formed.

The fourth collar 258 may extend generally outward from the second member 248 between the third collar 254 and the second flange 256. The fourth collar 258 is positioned proximate the second end 252 of the second member 248 and is separated from the second flange 256 by a predetermined minimum distance. For example, if the predetermined minimum distance is one millimeter, the fourth collar 258 will be separated from the second flange 256 by at least one millimeter. The fourth collar 258 may be integrally formed with the second member 248, although it will be appreciated that the fourth collar 258 may be separately formed.

The second bobbin element 14 may also include a second terminal bar 274 proximate the first end 250 of the second member 248. The second terminal bar 274 may be adapted to receive a second set of terminal pins 278. The third collar 254 and the second terminal bar 274 may serve to retain the second set of terminal pins 278 when the second set of terminal pins 278 is received by the second terminal bar 274. The second terminal bar 274 may be integrally formed with the second member 248, although it will be appreciated that the second terminal bar 274 may be separately formed.

Figure 7:
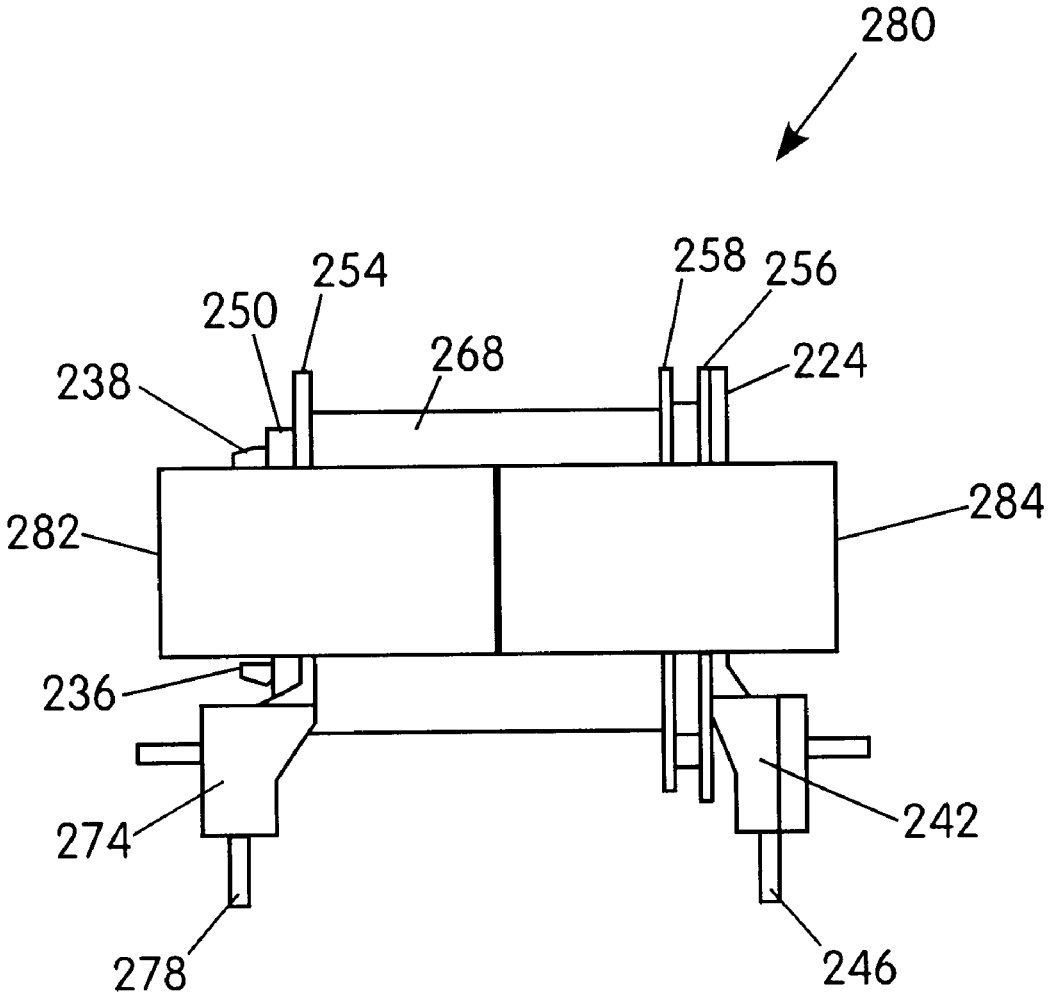
FIG. 7 illustrates a side view of a transformer incorporating the telescoping bobbin described hereinabove with respect to FIGS. 5 and 6.
Figure 8:
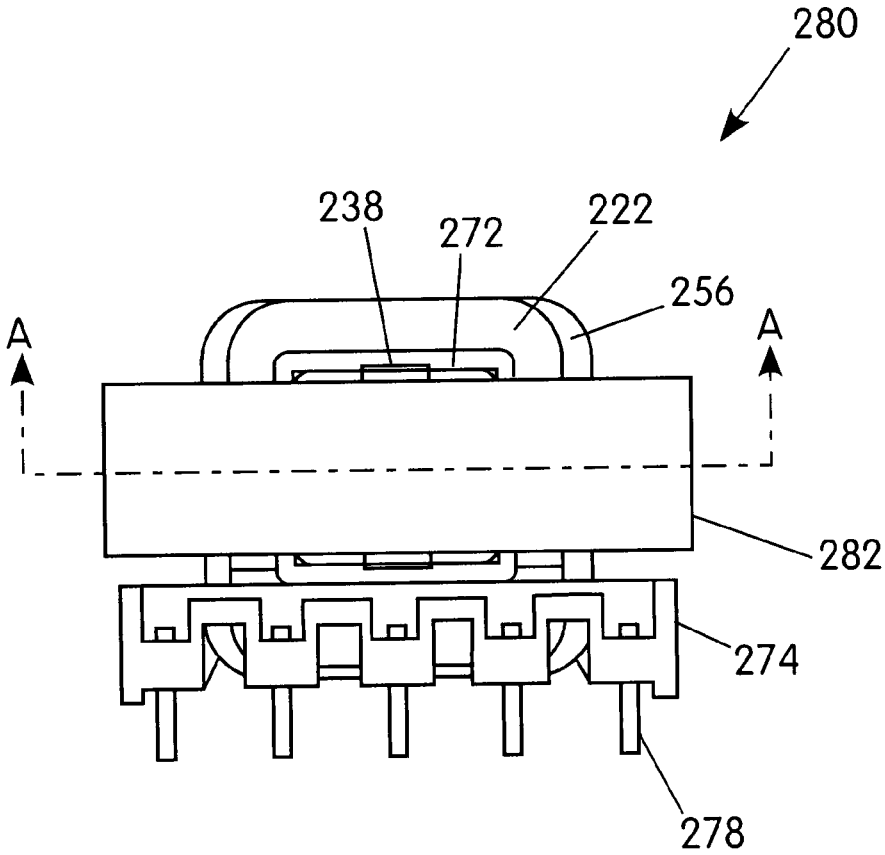
FIG. 8 illustrates an end view of a transformer incorporating the telescoping bobbin described hereinabove with respect to FIGS. 5 and 6.

FIGS. 7 and 8 illustrate a side view and an end view respectively of a transformer 280 incorporating the telescoping bobbin 210 described hereinabove with respect to FIGS. 5 and 6. In addition to including the telescoping bobbin 210, the transformer 280 also includes a primary winding of conductive wire 281*a*, a secondary winding of conductive wire 281*b*, the first and second set of terminal pins 246, 278, respectively, and first and second magnetic cores 282, 284, respectively. For purposes of clarity, the primary and secondary windings 281 a, 281*b*, respectively, of transformer 280 are not shown in FIGS. 7 and 8.

The primary winding of conductive wire 281*a* may be wound around the second surface 234 of the first member 216 between the first collar 222 and the second collar 240. The secondary winding of conductive wire 281*b* may be wound around the second surface 268 of the second member 248 between the third collar 254 and the fourth collar 258. As is well known in the art, the leads of the primary winding of conductive wire may, for example, be terminated at the first set of terminal pins 246 and the leads of the secondary winding of conductive wire may, for example, be terminated at the second set of terminal pins 278. The first and second sets of terminal pins 246, 278, respectively, may serve as electrical connecting points to the transformer 280. The first and second magnetic cores 282, 284, respectively, may be similar to the first and second magnetic cores 100, 102, respectively, described hereinabove with respect to FIG. 4. The transformer 280 may, for example, be a component in an AC/DC converter utilized as an external adapter for devices such as, for example, cable modems, personal computers, laptop computers, palm pilots, or other devices.

Figure 8A:
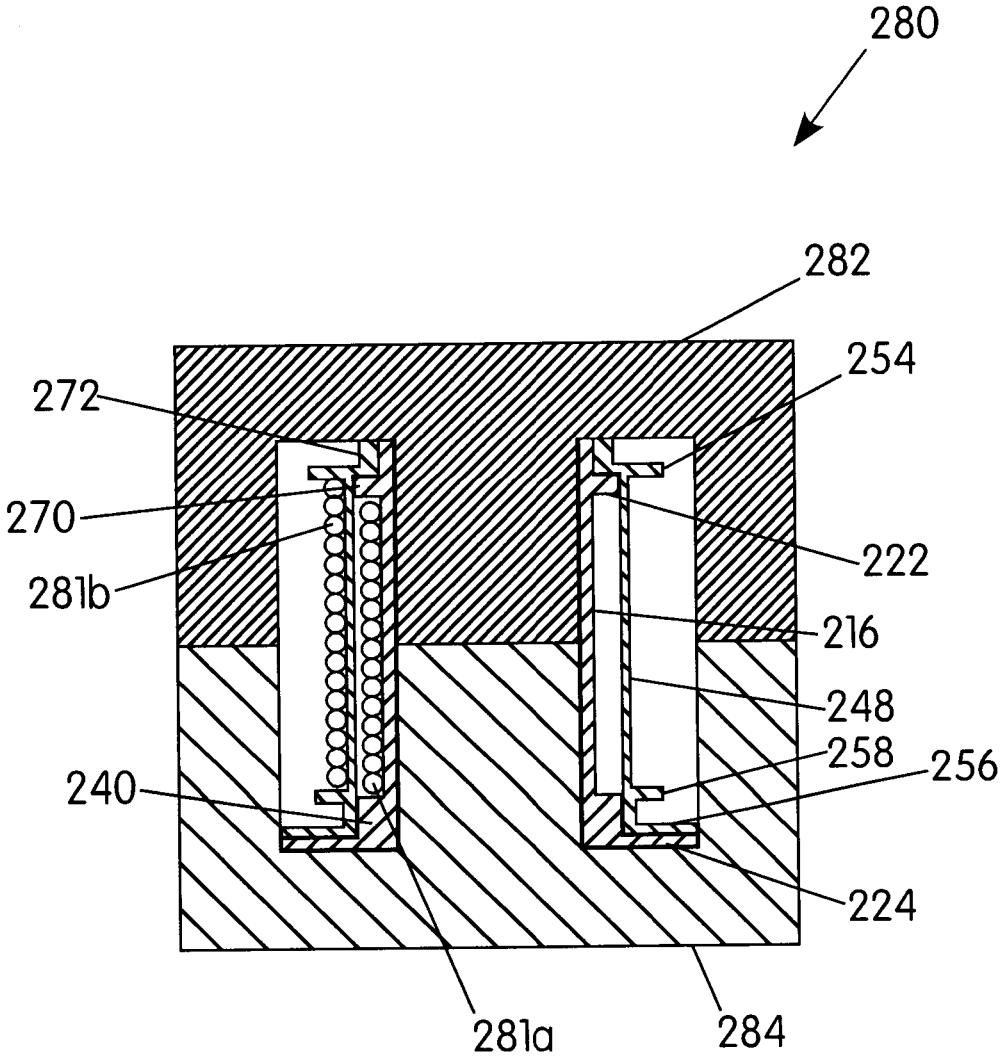
FIG. 8A illustrates a cross-sectional view of the transformer projected from plane A—A of FIG. 8.

FIG. 8A illustrates a cross-sectional view of the transformer 94 projected from plane A—A of FIG. 8. As discussed hereinabove, as the size of a transformer is reduced, it becomes increasingly difficult to maintain the minimum creeping distance between certain conductive components as required by various safety regulations. FIG. 8A illustrates features of the present invention that cooperate to maintain the required creeping distance between certain electrical conductors.

With respect to features of the telescoping bobbin 210 incorporated into the transformer 280, the length of the first member 216 from the first collar 222 to the first end 218 of the first member 216 may serve to lengthen the creeping distance from the primary winding of conductive wire 281*a* wound around the second surface 234 of the first member 216 to the first magnetic core 282 proximate the first end 218 of the first member 216. The first flange 224 may serve to lengthen the creeping distance from the primary winding of conductive wire 281*a* to the second magnetic core 284 proximate the second end 220 of the first member 216. The overlapping of the first collar 222 with the shoulder 270 of the second member 248 may serve to lengthen the creeping distance from the primary winding of conductive wire 281*a* to the secondary winding of conductive wire 281*b* proximate the first ends 218, 250, respectively, of the first and second members 216, 248 respectively. The overlapping of the first collar 222 with the shoulder 270 of the second member 248 may also serve to lengthen the creeping distance from the primary winding of conductive wire 281*a* to the first magnetic core 282 proximate the first end 218 of the first member 216. The second flange 256 may serve to lengthen the creeping distance from the secondary winding 281*b* to the lead wires of the primary winding proximate the second ends 220, 252 of the first and second members 216, 248 respectively. The second flange 256 may also act in conjunction with the second collar 240 and the fourth collar 258 to lengthen the creeping distance from primary winding 281*a* to the secondary winding 281*b* proximate the second ends 220, 252, respectively, of the first and second members 216, 248 respectively.

Figure 9:
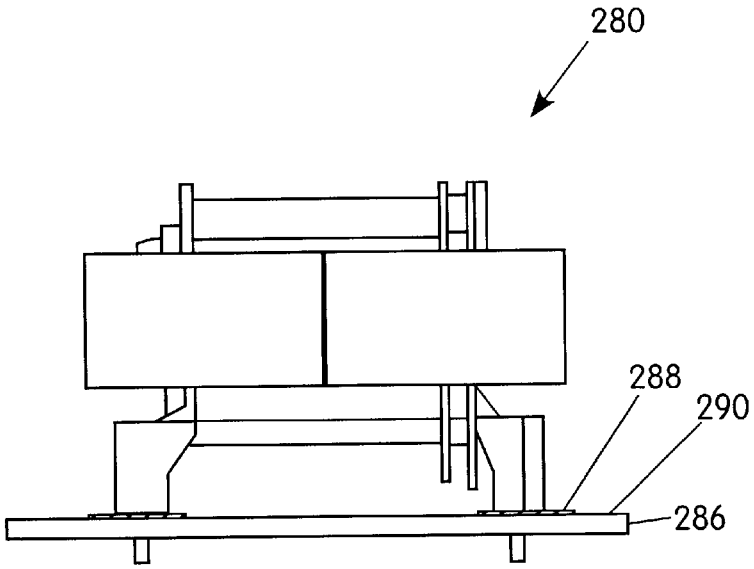
FIG. 9 illustrates a side view of the transformer connected to a printed circuit board having a circuit trace on a top surface.
Figure 10:
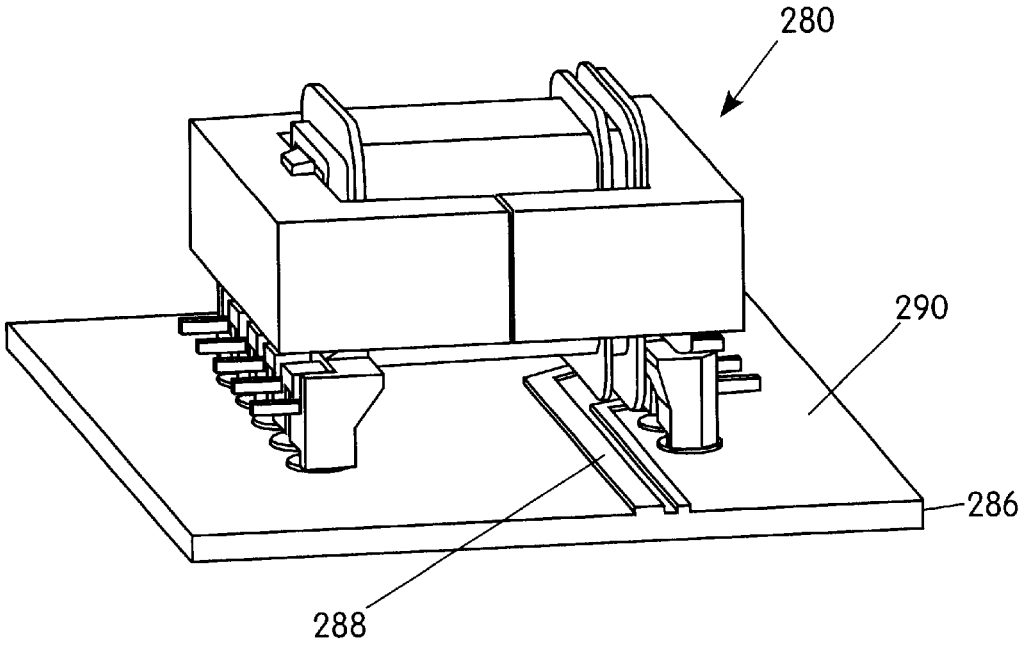
FIG. 10 illustrates another side view of the transformer connected to a printed circuit board having a circuit trace on a top surface.

FIG. 9 and 10 illustrate side views of the transformer 280 connected to a printed circuit board 286 having a circuit trace 288 on a top surface 290. It is well known in the art for a transformer to be connected to a printed circuit board having a top surface that includes a circuit trace. When the transformer 280 is connected to a printed circuit board 286 via the first and second sets of terminal pins 246, 278, respectively, the second flange 256 is positioned a predetermined minimum distance from the circuit trace 288. For example, if the predetermined minimum distance is one millimeter, the second flange 256 will be at least one millimeter away from the circuit trace 288. This separation provides adequate total isolation clearance from the first set of terminal pins 246 and any associated circuit traces 288 to the secondary winding of conductive wire 281*b*.

Although the present invention has been described and illustrated in detail herein with respect to certain embodiments, it is clearly understood that the same is by way of example and is not to be taken by way of limitation. It will be appreciated by those of ordinary skill in the art that numerous modifications and variations of the present invention may be implemented without departing from the spirit and scope of the present invention as described in the appended claims.

What is claimed is:

1. A telescoping bobbin, comprising:

a first bobbin element including:

a first member having first and second ends;

a first flange extending from the first end of the first member; and a first base extending from the second end of the first member; and a second bobbin element adapted to receive at least a portion of the first bobbin element, the second bobbin element including:

a second member having first and second ends;

a second flange extending from the first end of the second member, the second flange having first and second portions, wherein the first portion extends generally outward from the second member, and wherein the second portion extends generally inward from the second member, the second portion adjacent the first flange when the first bobbin element is received by the second bobbin element; and a second base extending from the second end of the second member, wherein the second base covers at least a portion of the first base when the first bobbin element is received by the second bobbin element.

2. The telescoping bobbin of claim 1, wherein the first and second bobbin elements are fabricated from a dielectric material.

3. The telescoping bobbin of claim 1, wherein the first member defines a first hollow opening having first and second ends, and wherein the second member defines a second hollow opening having first and second ends.

4. The telescoping bobbin of claim 3, wherein the second hollow opening is sized to receive the first flange and the first member when the first bobbin element is received by the second bobbin element.

5. The telescoping bobbin of claim 1, wherein the first member is a generally rectangularly shaped column, and wherein the second member is a generally rectangularly shaped column.

6. The telescoping bobbin of claim 1, wherein the first member is a generally cylindrically shaped column, and wherein the second member is a generally cylindrically shaped column.

7. The telescoping bobbin of claim 1, wherein the first flange extends generally outward from the first end of the first member.

8. The telescoping bobbin of claim 1, wherein the first base includes:

first and second terminal bars extending from the second end of the first member; and first and second lips between the first and second terminal bars.

9. The telescoping bobbin of claim 8, wherein the first terminal bar is adapted to receive a first set of terminal pins, and wherein the second terminal bar is adapted to receive a second set of terminal pins.

10. The telescoping bobbin of claim 8, wherein first lip is adjacent the first terminal bar, and wherein the second lip is adjacent the second terminal bar.

11. The telescoping bobbin of claim 1, wherein the first base defines first and second grooves, and wherein the second base includes first and second ridges, the first and second ridges cooperating with the first and second grooves when the first bobbin element is received by the second bobbin element.

12. The telescoping bobbin of claim 1, wherein the first flange and the first base are integrally formed with the first member.

13. The telescoping bobbin of claim 1, wherein the first base includes a locking ramp, and wherein the second base includes a locking tab, the locking tab cooperating with the locking ramp when the first bobbin element is received by the second bobbin element.

14. The telescoping bobbin of claim 1, wherein the second base includes:

a flange portion extending from the second end of the second member; and a skirt portion extending from the flange portion.

15. The telescoping bobbin of claim 14, wherein the flange portion extends generally outward from the second end of the second member, and wherein the skirt portion extends generally downward from the flange portion of the second base.

16. The telescoping bobbin of claim 1, wherein the second flange and the second base are integrally formed with the second member.

17. The telescoping bobbin of claim 1, wherein the second bobbin element further includes a collar extending from the second member proximate the first end of the second member.

18. The telescoping bobbin of claim 17, wherein the collar extends generally outward from the second member.

19. The telescoping bobbin of claim 1, wherein the second bobbin element further includes a collar extending from the second member proximate the second end of the second member.

20. The telescoping bobbin of claim 1, wherein the second bobbin element further includes first and second collars, the first collar extending from the second member proximate the first end of the second member, the second collar extending from the second member proximate the second end of the second member.

21. A telescoping bobbin, comprising:

a first bobbin element including:

a first member having first and second ends;

a first flange extending from the first end of the first member; and a first base having first and second terminal bars, the first base extending from the second end of the first member; and a second bobbin element adapted to receive at least a portion of the first bobbin element, the second bobbin element including:

a second member having first and second ends;

a second flange extending from the first end of the second member; and a second base extending from the second end of the second member, wherein the second base covers at least a portion of the first base when the first bobbin element is received by the second bobbin element, the second base including:

a flange portion extending from the second end of the second member; and a skirt portion extending from the flange portion.

22. A telescoping bobbin, comprising:

a first bobbin element including:

a first member having first and second ends;

a first flange extending from the first end of the first member; and a first base having first and second terminal bars, the first base extending from the second end of the first member; and a second bobbin element adapted to receive at least a portion of the first bobbin element, the second bobbin element including:

a second member having first and second ends;

a second flange extending from the first end of the second member, the second flange having first and second portions, wherein the first portion extends generally outward from the second member, and wherein the second portion extends generally inward from the second member, the second portion positioned adjacent the first flange when the first bobbin element is received by the second bobbin element; and a second base extending from the second end of the second member, wherein the second base covers at least a portion of the first base when the first bobbin element is received by the second bobbin element, the second base including:

a flange portion extending from the second end of the second member; and a skirt portion extending from the flange portion.

23. A transformer, comprising:

a first magnetic core having at least one pole piece;

a second magnetic core having at least one pole piece;

a telescoping bobbin having first and second bobbin elements, the second bobbin element adapted to receive at least a portion of the first bobbin element, wherein the first bobbin element includes:

a first member having first and second ends, the first member adapted to receive at least a portion of the at least one pole piece of the first magnetic core and at least a portion of the at least one pole piece of the second magnetic core;

a first flange extending from the first end of the first member; and a first base extending from the second end of the first member, and wherein the second bobbin element includes:

a second member having first and second ends;

a second flange extending from the first end of the second member, the second flange having first and second portions, wherein the first portion extends generally outward from the second member, and wherein the second portion extends generally inward from the second member, the second portion adjacent the first flange when the first bobbin element is received by the second bobbin element; and a second base extending from the second end of the second member, wherein the second base covers at least a portion of the first base when the first bobbin element is received by the second bobbin element; and a primary winding of conductive wire wound around the first member;

a secondary winding of conductive wire wound around the second member;

a first set of terminal pins connected to the primary winding of conductive wire;

a second set of terminal pins connected to the secondary winding of conductive wire;

a first insulation shield adjacent the first flange; and a second insulation shield adjacent the second base.

24. The transformer of claim 23, wherein the first and second magnetic cores arc E-shaped magnetic cores.

25. The transformer of claim 23, wherein the first base includes:

first and second terminal bars extending from the second end of the first member; and first and second lips between the first and second terminal bars.

26. The transformer of claim 23, wherein the second base includes:

a flange portion extending from the second end of the second member; and a skirt portion extending from the flange portion.

27. A telescoping bobbin, comprising:

a first bobbin element including:

a first member having first and second ends;

a first collar extending from the first member proximate the first end of the first member; and a first flange extending from the second end of the first member; and a second bobbin element adapted to receive at least a portion of the first bobbin element, the second bobbin element including:

a second member having first and second ends, a shoulder extending therefrom proximate the first end of the second member, and a neck portion at the first end of the second member;

a third collar extending from the second member proximate the first end of the second member;

a second flange extending from the second end of the second member; and a fourth collar extending from the second member proximate the second end of the second member, wherein the fourth collar is between the third collar and the second flange.

28. The telescoping bobbin of claim 27, wherein the first and second bobbin elements are fabricated from a dielectric material.

29. The telescoping bobbin of claim 27, wherein the first member defines a first hollow opening having first and second ends, and wherein the second member defines a second hollow opening having first and second ends.

30. The telescoping bobbin of claim 29, wherein the second hollow opening is sized to receive the first collar and the first member when the first bobbin element is received by the second bobbin element.

31. The telescoping bobbin of claim 27, wherein the first and second members have a generally rectangular shape.

32. The telescoping bobbin of claim 27, wherein the first and second members have a generally cylindrical shape.

33. The telescoping bobbin of claim 27, wherein the first collar extends generally outward from the first member proximate the first end of the first member.

34. The telescoping bobbin of claim 27, wherein the first flange extends generally outward from the second end of the first member.

35. The telescoping bobbin of claim 27, wherein the first collar and the first flange are integrally formed with the first member.

36. The telescoping bobbin of claim 27, wherein the first bobbin element further includes:

first and second locking tabs extending from the first end of the first member;

a second collar extending from the first member proximate the second end of the first member; and a first terminal bar proximate the second end the second end of the first member.

37. The telescoping bobbin of claim 36, wherein the first terminal bar is adapted to receive a first set of terminal pins.

38. The telescoping bobbin of claim 36, wherein the first and second locking tabs, the second collar, and the first terminal bar are integrally formed with the first member.

39. The telescoping bobbin of claim 27, wherein the shoulder extends generally inward from the second member proximate the first end of the second member, the shoulder adjacent and overlapping the first collar when the first bobbin element is received by the second bobbin element.

40. The telescoping bobbin of claim 27, wherein the neck portion has a uniform cross-sectional area, the cross-sectional area of the neck portion being less than the cross-sectional area of the second member at the second end of the second member.

41. The telescoping bobbin of claim 36, wherein the first and second locking tabs of the first member cooperate with the neck portion of the second member at the first end of the second member when the first bobbin element is received by the second bobbin element.

42. The telescoping bobbin of claim 27, wherein the third collar extends generally outward from the second member proximate the first end of the second member.

43. The telescoping bobbin of claim 27, wherein the second flange extends generally outward from the second end of the second member, the second flange adjacent and overlapping the first flange when the first bobbin element is received by the second bobbin element.

44. The telescoping bobbin of claim 27, wherein the fourth collar extends generally outward from the second member between the third collar and the second flange.

45. The telescoping bobbin of claim 44, wherein the fourth collar is proximate the second end of the second member and is separated from the second flange by a predetermined minimum distance.

46. The telescoping bobbin of claim 27, wherein the third collar, the second flange, and the fourth collar are integrally formed with the second member.

47. The telescoping bobbin of claim 27, wherein the second bobbin element further includes a second terminal bar proximate the first end of the second member.

48. The telescoping bobbin of claim 47, wherein the second terminal bar is adapted to receive a second set of terminal pins.

49. The telescoping bobbin of claim 47, wherein the second terminal bar is integrally formed with the second member.

50. A transformer, comprising:

a first magnetic core having at least one pole piece;

a second magnetic core having at least one pole piece;

a telescoping bobbin having first and second bobbin elements, the second bobbin element adapted to receive at least a portion of the first bobbin element, wherein the first bobbin element includes:

a first member having first and second ends, the first member adapted to receive at least a portion of the at least one pole piece of the first magnetic core and at least a portion of the at least one pole piece of the second magnetic core;

a first collar extending from the first member proximate the first end of the first member; and a first flange extending from the second end of the first member, and wherein the second bobbin element includes:

a second member having first and second ends, a shoulder extending therefrom proximate the first end of the second member, and a neck portion at the first end of the second member;

a third collar extending from the second member proximate the first end of the second member;

a second flange extending from the second end of the second member; and a fourth collar extending from the second member proximate the second end of the second member, wherein the fourth collar is between the third collar and the second flange; and a primary winding of conductive wire wound around the first member;

a secondary winding of conductive wire wound around the second member;

a first set of terminal pins connected to the primary winding of conductive wire;

a second set of terminal pins connected to the secondary winding of conductive wire.

51. The transformer of claim 50, wherein the transformer is connected to a printed circuit board, the printed circuit board including a top surface having a circuit trace, and wherein the second flange is separated from the circuit trace by a predetermined minimum distance.

* * * * *

UNITED STATES PATENT AND TRADEMARK OFFICE

CERTIFICATE OF CORRECTION

PATENT NO. : 6,344,786 B1
DATED : February 5, 2002
INVENTOR(S) : Chin

It is certified that error appears in the above-identified patent and that said Letters Patent is hereby corrected as shown below:

Column 14,
Line 41, please delete the word "arc" immidiately after the phrase "first and second magnetic cores" and substitute the word -- are -- therefor.

Signed and Sealed this

Thirtieth Day of July, 2002

*Attest:*

*Attesting Officer*

JAMES E. ROGAN
*Director of the United States Patent and Trademark Office*